US007025641B2

(12) United States Patent
Nayrac et al.

(10) Patent No.: US 7,025,641 B2
(45) Date of Patent: Apr. 11, 2006

(54) ASSEMBLY OF A BOOT AND AN INSERTING DEVICE

(75) Inventors: Frederic Nayrac, Bour les Valence (FR); Jean-Luc Simonin, Barcelonne (FR)

(73) Assignee: Societe de Prospection et d'Inventions Techniques Spit, Bourg-les-Valence (FR)

( * ) Notice: Subject to any disclaimer, the term of this patent is extended or adjusted under 35 U.S.C. 154(b) by 0 days.

(21) Appl. No.: 10/701,182

(22) Filed: Nov. 5, 2003

(65) Prior Publication Data

US 2004/0132354 A1 Jul. 8, 2004

(30) Foreign Application Priority Data

Nov. 6, 2002 (FR) ..... 02 13862

(51) Int. Cl.
*H01R 9/22* (2006.01)

(52) U.S. Cl. ..... 439/894; 227/8

(58) Field of Classification Search ..... 173/DIG. 2; 227/8, 11, 109; 439/894
See application file for complete search history.

(56) References Cited

U.S. PATENT DOCUMENTS

| | | | | |
|---|---|---|---|---|
| 4,375,867 | A | 3/1983 | Novak et al. | |
| 6,041,603 | A * | 3/2000 | Phillips | 60/632 |
| 6,609,646 | B1 * | 8/2003 | Miller et al. | 227/8 |
| 6,729,523 | B1 * | 5/2004 | Wang et al. | 227/120 |

* cited by examiner

*Primary Examiner*—Thanh-Tam Le
(74) *Attorney, Agent, or Firm*—Lowe Hauptman & Berner, LLP

(57) ABSTRACT

An inserting device (3) of an assembly (1) includes a wall-plug guide (31) and a contact foot (32). The boot (2) has a head (25) pierced by a through hole (21) for the wall-plug guide (31), a stock (27) provided with stiffeners (23), and a foot (26) pierced by a through hole (22) for the contact foot (32). The through hole (21) of the wall-plug guide (31) and the through hole (2) of the contact foot (32) act in combination to keep the boot (2) on the device (3).

20 Claims, 4 Drawing Sheets

ASSEMBLY OF A BOOT AND AN INSERTING DEVICE

FIELD OF THE INVENTION

The invention relates to a device for inserting wall fixings, especially a device operated by compressed gas.

More precisely, the invention relates to an inserting device that comprises, in the axis of a gun, a wall-plug guide whose job is to guide the fixing element, or wall-plug into the material for which it is intended. The wall-plug guide acts in combination with a contact foot to position the device with respect to the surface of the material.

BACKGROUND OF THE INVENTION

The wall-plug is inserted at right angles into the surface of the material. Consequently, when fixing wall-plugs in a ceiling, the device is underneath the ceiling during insertion and is therefore liable to receive dust and other particles produced by the insertion of the plug. The effect of this is to accelerate the wear of the mechanism of the device and to interfere with its operation.

SUMMARY OF THE INVENTION

It is an object of the present invention to reduce these problems.

To this end the present application relates to an assembly consisting of a wall-plug inserting device and a boot, the inserting device comprising a wall-plug guide and a contact foot which helps the wall-plug guide to position the device with respect to the surface of the material into which a wall-plug is to be inserted, the boot being designed to cover the device and having means designed to engage with the wall-plug guide and means designed to engage with the contact foot and thus retain the boot on the device.

It is thus the contact foot and the wall-plug guide which keep the boot on the device.

The boot is preferably provided with a through hole for the wall-plug guide and with a through hole for the contact foot.

Preferably, again, the boot is held on the device, more particularly at the instant of firing, by the bracing of the boot between the through hole of the wall-plug guide and the through hole of the contact foot.

Preferably, too, the boot is provided with stiffening ribs.

The device advantageously comprises a pushbutton, for a feed magazine of wall-plugs, and the boot comprises a recess for access to the said pushbutton.

Advantageously also, the boot is provided with a bellows which embraces the wall-plug guide.

The boot of the invention thus comprises a pierced head, a stock and pierced foot.

BRIEF DESCRIPTION OF THE DRAWINGS

A clearer understanding of the invention will be gained from the following description of the preferred embodiment of the invention, in which.

DETAILED DESCRIPTION OF THE PREFERRED EMBODIMENTS

The description will refer to an inserting device operated by compressed gas, but it goes without saying that the Applicant does not mean by this to be limited to this type of inserting device. Any other inserting device may be envisaged, such as inserting devices using explosive charges.

Also, the description which follows will refer to the case in which the device 3 is vertical, that is to say the axis 4 of the gun is horizontal, the boot being positioned relative to the device 3 accordingly, in order to be able to be fitted onto it. Thus, when for example a face of the device is said to be vertical, it will mean that it is vertical in this position.

Figure 1:
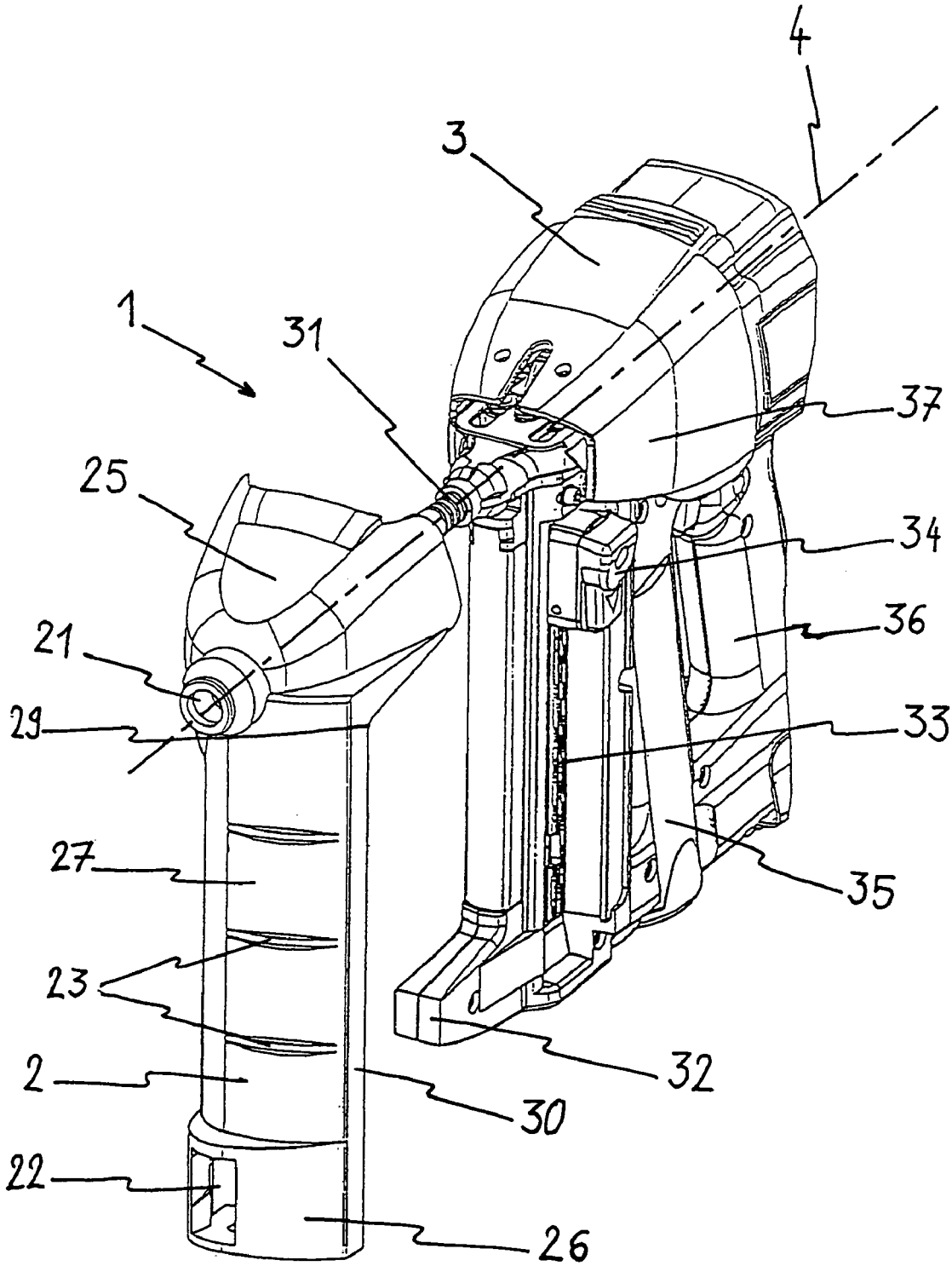
FIG. 1 is a partial perspective view of the assembly of the invention, when the boot is not fitted on the inserting device.

Referring to FIG. 1, the assembly 1 of the present invention comprises an inserting device 3 and a boot 2 designed to fit together. The inserting device 3 comprises a grip 36, a housing for a compressed gas cartridge 35, a wall-plug feed magazine 33 and its pushbutton 34, a wall-plug guide 31 extending along an axis 4, a contact foot 32 and a casing 37. The boot 2 is made of rigid plastic as a one-piece moulding. However, three parts can be distinguished within its general shape: a head 25, a foot 26 and a stock 27. These three parts are shaped so as to cover the corresponding parts of the inserting device 3. Also, the head 25 has a through hole 21 for the wall-plug guide 31, the foot 26 has a through hole 22 for the contact foot 32, and the stock 27 has stiffening ribs 23.

Without going into details, the use of the inserting device 3 is as follows: an operator grasps the device 3 by the grip 36. He presses the device 3 against the surface of the material into which he wishes to insert a wall-plug, so that the axis 4 of the wall-plug guide 31 is perpendicular to the said surface. The wall-plug guide 31, which is telescopic, will therefore depress slightly. The operator controls the perpendicularity of the axis 4 with the surface of the material by means of the interaction of the wall-plug guide 31 and contact foot 32. The pressure of the wall-plug guide 31 is also useful from the point of view of safety, because the wall-plug cannot be fired without this pressure. Once the wall-plug guide 31 is pressed against the surface, therefore, the device can be fired. The compressed gas held in the cartridge inside the housing 35 propels the wall-plug from the wall-plug feed magazine 33, which can be opened or closed using the pushbutton 34, into the support.

The job of the boot 2 is to cover the device 3 and so protect it against the intrusion of dust. Thus the head 25, situated around the through hole 21 of the wall-plug guide 31, covers the upper part of the inserting device 3; it covers and in fact surrounds the upper part of the inserting device, as can be seen particularly by means of its part 28, except here on the left-hand side where there is a recess 29 allowing free access to the pushbutton 34, once the boot 2 is in place.

The stock 27 consists of a surface which, when the boot 2 is on the device 3, is practically vertical, optionally convex, with side walls 30 extending towards the device 3. It protects the vertical front face of the device 3. It has horizontal stiffening ribs 23, formed for example by displacement of material.

Figure 2:
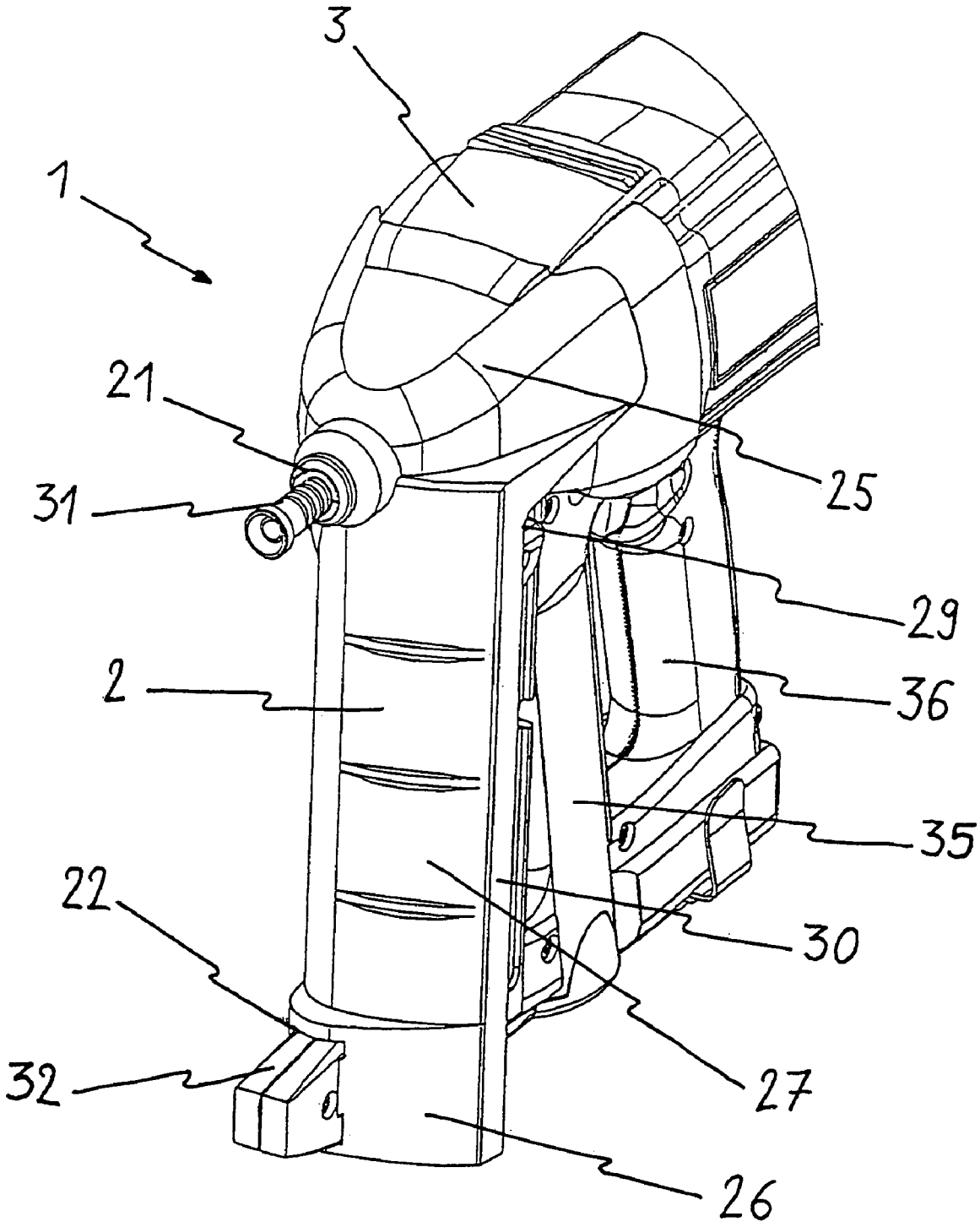
FIG. 2 is a partial perspective view of the assembly seen in FIG. 1, when the boot is fitted on the inserting device.

The foot 26 is shaped in such a way as to protect the lower part of the apparatus 3. It too contains a through hole 22 for the contact foot 32. The head 25 has a similar through hole 21 for the wall-plug guide 31. Hence the positioning of these two holes 21, 22 onto the wall-plug guide 31 and the contact foot 32, respectively, has the effect of fitting the boot 2 onto the device 3, as can be seen in FIG. 2, so that the boot 2 thereby covers the whole of the front face to the device 3. This front face of the device 3 is therefore protected against the intrusion of dust and other particles when inserting a wall-plug into a horizontal support located above the device 3, in particular.

Figure 3:
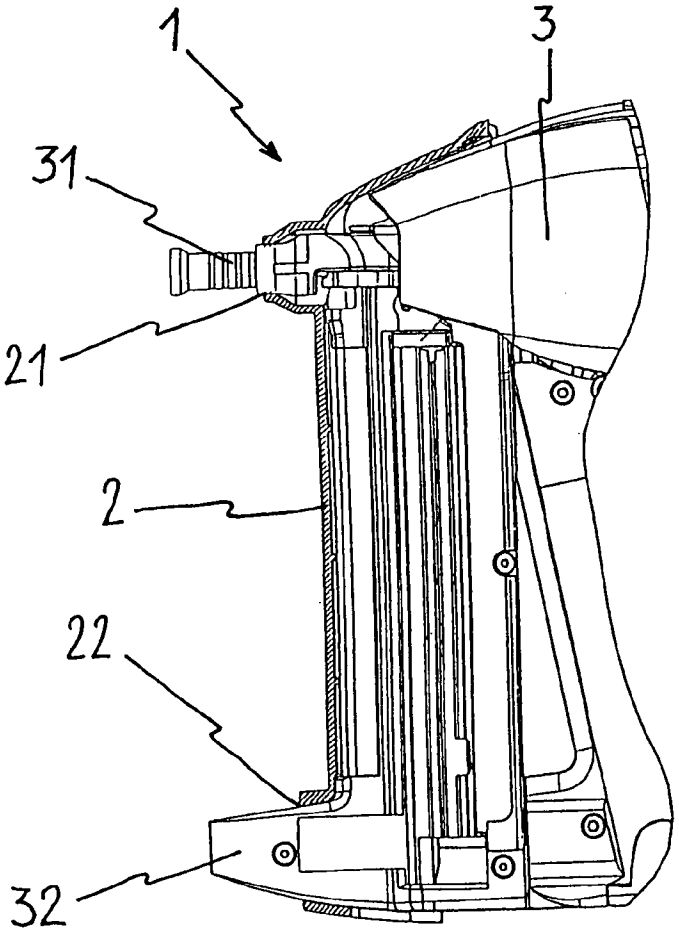
FIG. 3 is a partial side view, partly in section, of the assembly seen in FIG. 2.

Referring to FIG. 3, it can be seen that once fitted, the boot is a close fit on the device 3, and protects the whole of the front face of the device 3, with the exception of the wall-plug guide 31 and the contact foot 32.

Figure 4:
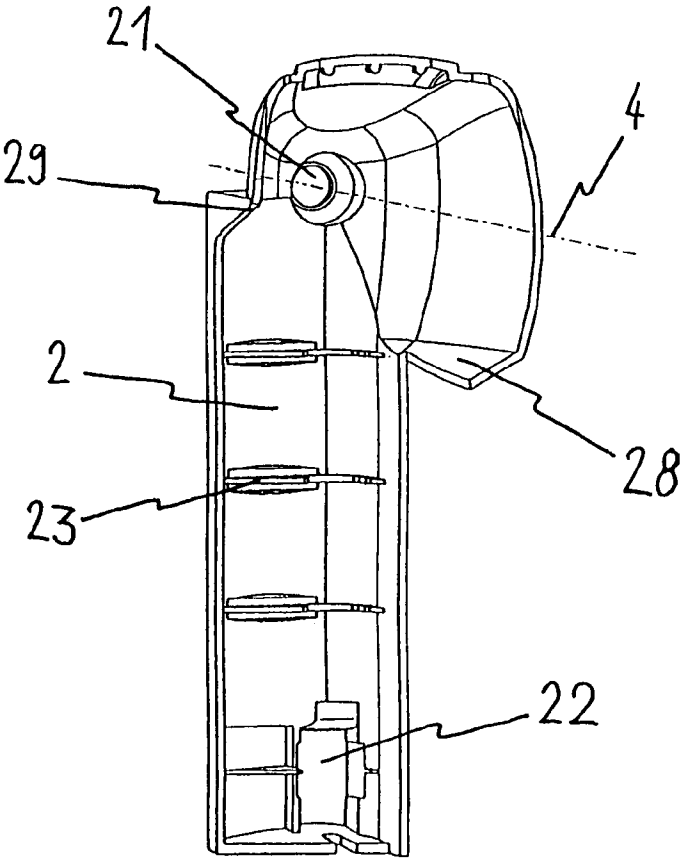
FIG. 4 is a rear perspective view of the boot of the assembly of the invention.

Referring to FIG. 4, the boot 2 is therefore produced as a one-piece moulding. The through holes 21, 22 for the wall-plug guide 31 and the contact foot 32, respectively, are designed to hold the boot 2 on the device 3 by engagement with the wall-plug guide 31 and the contact foot 32. The boot 2 therefore has no need for additional fixing or retaining means. Retention is provided by a bracing action, especially here at the instant of firing, because at this moment the wall-plug guide 31 recoils, bracing the boot 2 between the two through holes 21, 22 of the wall-plug guide 31 and the contact foot 32, respectively. This bracing action keeps the boot 2 on the device 3.

Figure 5:
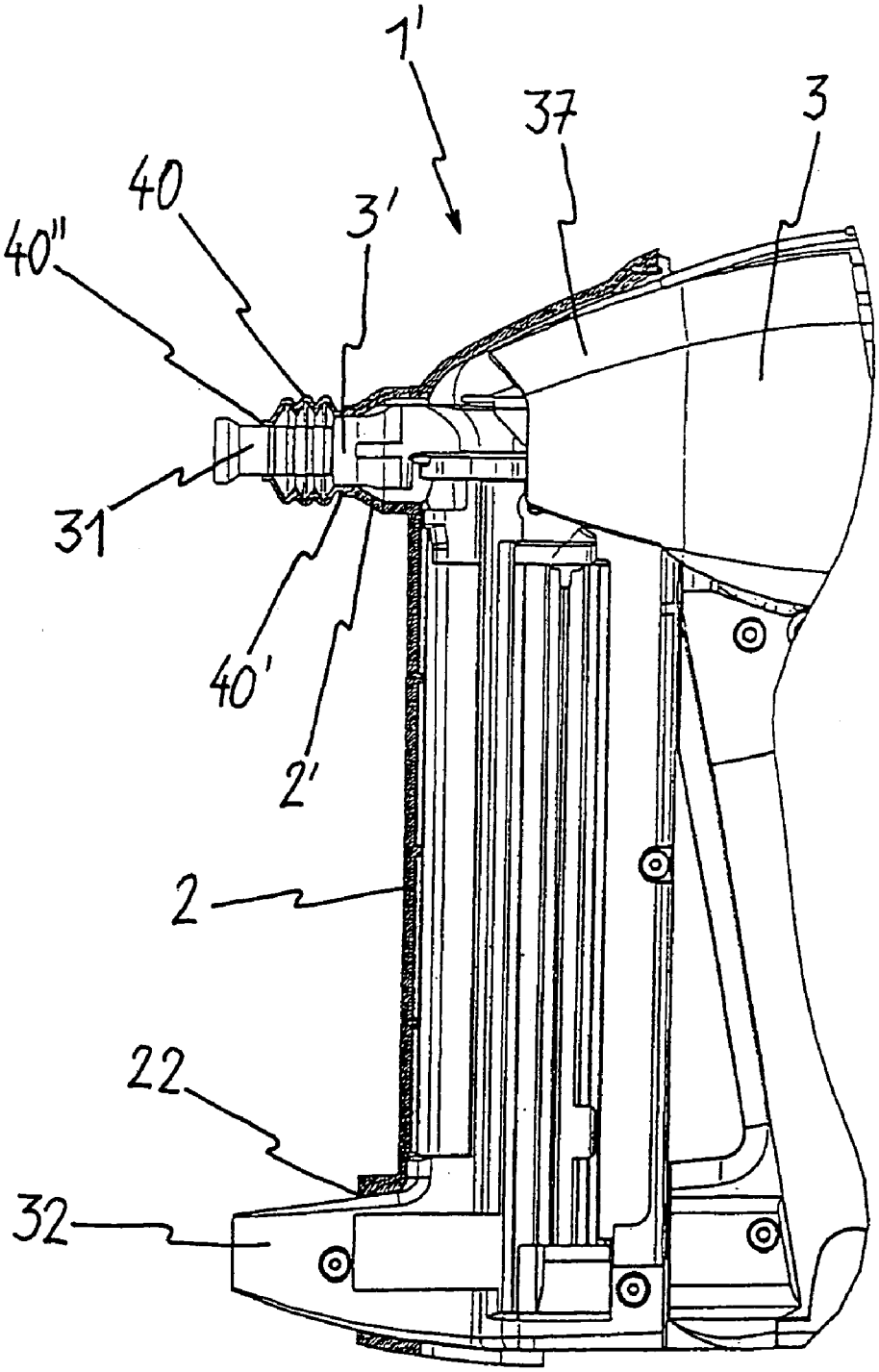
FIG. 5 is a partial side view, partly in section, of another embodiment of the assembly of the invention.

Lastly, referring to FIG. 5, it is possible to provide a bellows 40 on the axis 4 of the through hole 21 of the wall-plug guide 31. Here, the rigid part 2' of the boot 2 stops around the through hole 21 of the wall-plug guide 31, at the limit of the part 3' of the device 3 which remains stationary with respect to the casing 37 when the device is fired, the wall-plug guide 31 being telescopic. AS a result, this telescopic wall-plug guide 31 is caused to recede when the device 3 is pressed against the surface, and to move along its axis 4 when the plug is fired. Consequently the rigid part 2' of the boot 2 cannot press against it, because it would interfere with its operation. However, protection against dust may also be useful at the junction between the fixed part 3' and the telescopic wall-plug guide 31. It is therefore proposed in the embodiment seen in FIG. 5 to add a bellows 40, the free end 40" of which grips the wall-plug guide 31, while the other end 40' is joined to the rigid part 2' of the boot 2, around the through hole 21 of the wall-plug guide 31. Consequently when the wall-plug guide 31 moves, the end 40" of the bellows 40 stays in contact with this telescopic part 31 and follows it in its movement. This contact keeps dust out and protects the junction between the telescopic part 31 and the fixed part 3'.

The invention claimed is:

1. An assembly, comprising:

a fastener driving device; and a boot;

the device comprising a fastener guide for guiding a fastener toward a substrate and a contact foot for facilitating positioning the fastener guide with respect to a surface of the substrate into which the fastener is to be driven;

the boot being adapted to cover the device and comprising a first element engageable with the fastener guide and a second element engageable with the contact foot for retaining the boot on the device;

wherein the boot further comprises a bellows which grips the fastener guide.

2. The assembly according to claim 1, wherein the first element is a first through hole through which said fastener guide is passable and the second element is a second through hole through which said contact foot is passable.

3. The assembly according to claim 2, wherein the boot is retained on the device exclusively by insertion of said fastener guide and contact foot into said first and second through holes, respectively, without any other fixing or retaining means.

4. The assembly according to claim 1, wherein the boot further comprises horizontal stiffening ribs vertically spaced from each other and arranged between the first and second elements.

5. The assembly according to claim 1, further comprising a fastener feed magazine different from said boot and attachable to said device at a location behind said contact foot.

6. The assembly according to claim 1, wherein said device further comprises a front part, said fastener guide telescopically projecting forwardly from said front part and being rearwardly retractable into said front part;

the first element of said boot comprises a through hole through which said front part is passable, said front part being grip by a wall of said through hole when said boot is mounted on said device; and said bellows comprises a proximal end joined to said wall of said through hole and a distal end which grips the fastener guide when said boot is mounted on said device, said distal end being moveable relative to said proximal end in an axial direction of said bellows for following movements of said fastener guide relative to said front part.

7. The assembly according to claim 6, wherein said boot comprises a body which is more rigid than said bellows at least in said axial direction, said through hole being positioned on an upper portion of said body;

said body further comprises another through hole in a lower portion thereof, said contact foot being passable through said another through hole which defines the second element; and when said boot is mounted on said device, said contact foot projects forwardly, through and beyond said another through hole in a direction in which said fastener guide extends through and beyond said through hole and said bellows.

8. A boot mountable on and for covering a front side of a fastener driving device, the device comprising a front part and a fastener guide telescopically projecting forwardly from the front part and being rearwardly retractable into the front part, said boot comprising:

a bellow having a proximal end and a distal end moveable relative to said proximal end in an axial direction of said bellows; and a body which is more rigid than said bellows at least in said axial direction, said body having a through hole adapted to grip the front part of the device with a wall of said through hole when said boot is mounted on said device;

the proximal end of said bellows being joined to said wall of said through hole; and the distal end of said bellows projecting forwardly from said wall and being adapted to grip the fastener guide when said boot is mounted on said device for following movements of said fastener guide relative to said front part.

9. The boot of claim 8, wherein said through hole and said bellows are coaxial.

10. The boot of claim 8, wherein said through hole is positioned on an upper portion of said body;

said body further comprises another through hole in a lower portion thereof for gripping a contact foot of said device; and said another through hole has an axis extending in the axial direction of said bellows, whereby, when said boot is mounted on said device, said contact foot projects forwardly, through and beyond said another through hole in a direction in which said fastener guide extends through and beyond said through hole and said bellows.

11. The boot of claim 8, wherein said through hole is positioned on an upper portion of said body;

said body further comprises another through hole in a lower portion thereof for gripping a contact foot of said device; and said body further comprises a half sleeve portion between said through holes, said half sleeve portion having a convex front side and a concave rear side.

12. The boot of claim 11, wherein the walls of said through holes project forwardly of the front side of said half sleeve portion which further comprises, on the rear side, a number of stiffening ribs spaced from each other in a direction between the through holes.

13. The boot of claim 11, wherein the upper portion of said body is enlarged relative to said half sleeve portion and extends beyond said half sleeve portion both forwardly and rearwardly.

14. An assembly, comprising a fastener driving device, a fastener feed magazine, and a boot;

said device comprising:

a front part, a fastener guide for guiding a fastener forward, toward a substrate, said fastener guide telescopically projecting forwardly from the front part and being rearwardly retractable into the front part, a member extending downwardly from a rear portion of said front part, and a contact foot for facilitating positioning the fastener guide with respect to a surface of the substrate into which the fastener is to be driven;

said boot being mountable on said device to cover said front part, a rear side of said fastener guide, and a front side of said member; and said fastener feed magazine being different from said boot and attachable to said device at a location behind said member and said contact foot.

15. The assembly according to claim 14, wherein said contact foot extends forwardly from said member and defining together with said member an L shape.

16. The assembly according to claim 14, wherein said boot comprises an upper through hole through which said front past is passable, said front part being grip by a wall of said upper through hole when said boot is mounted on said device; and a bellows comprising a proximal end joined to said wall of said upper through hole and a distal end which grips the fastener guide when said boot is mounted on said device, said distal end being moveable relative to said proximal end in an axial direction of said bellows for following movements of said fastener guide relative to said front part.

17. The assembly according to claim 16, wherein said boot comprises a body which is more rigid than said bellows at least in said axial direction, said upper through hole being positioned on an upper portion of said body;

said body further comprises another, lower through hole in a lower portion thereof, said contact foot being passable through said lower through hole; and when said boot is mounted on said device, said contact foot projects forwardly, through and beyond said lower through hole in a direction in which said fastener guide extends through and beyond said upper through hole and said bellows.

18. The assembly of claim 17, wherein said body further comprises a half sleeve portion between said through holes, said half sleeve portion having a convex front side and a concave rear side.

19. The assembly of claim 18, wherein walls of said through holes project forwardly of the front side of said half sleeve portion which further comprises, on the rear side, a number of stiffening ribs spaced from each other in a vertical direction between the through holes.

20. The assembly of claim 19, wherein the upper portion of said body is enlarged relative to said half sleeve portion and extends beyond said half sleeve portion both forwardly and rearwardly.

* * * * *